US005652970A

United States Patent [19]

Wodeslavsky

[11] Patent Number: 5,652,970

[45] Date of Patent: Aug. 5, 1997

[54] TOILET WATER RESERVOIR WATER DUMPING VALVE FOR SEALING THE RESERVOIR'S WATER OUTLET BY HYDRAULIC PRESSURE, AND CONTROLLING WATER VOLUME

[76] Inventor: Josef Wodeslavsky, #5 Peter Lynas Ct., Tenafly, N.J. 07670

[21] Appl. No.: 659,629

[22] Filed: Jun. 6, 1996

[51] Int. Cl.[6] ..... E03D 3/02

[52] U.S. Cl. ..... 4/378; 4/415; 4/366; 4/367; 137/391; 251/61.1; 251/45

[58] Field of Search ..... 4/324, 378, 379, 4/380, 387, 388, 389, 390, 415, 366, 367, 354, 360, 361; 137/391, 410, 414; 251/45, 46, 61.1

[56] References Cited

U.S. PATENT DOCUMENTS

| | | | |
|---|---|---|---|
| 1,755,558 | 4/1930 | Owens | 4/361 |
| 3,074,684 | 1/1963 | Doyle | 137/414 |
| 5,408,705 | 4/1995 | Wodeslavsky | 4/366 |

FOREIGN PATENT DOCUMENTS

| | | | |
|---|---|---|---|
| 2435650 | 5/1980 | France | 4/378 |
| 809 | 2/1880 | United Kingdom | 4/378 |
| 93/05247 | 3/1993 | WIPO | 4/378 |

*Primary Examiner*—Henry J. Recla
*Assistant Examiner*—Charles R. Eloshway

[57] ABSTRACT

A toilet reservoir water dumping valve for sealing the reservoir's water outlet by hydraulic pressure and for controlling the water volume to be flushed. The dumping valve is situated in the toilet reservoir at the water outlet to the toilet bowl, the dumping valve comprising a membrane housing, and a rod connected to a flush valve. In a first position, when the flush lever is in OFF position, the membrane disconnects communication between the supply line and the reservoir. Simultaneously, the rod is pressed by hydraulic pressure, tightly pushing a flush valve against the reservoir exit. In a second position, when the water is flushed, the membrane opens communication between the supply line and the reservoir, reducing the pressure on the rod, such that the rod pulls the flush valve away from the reservoir outlet, permitting water to be flushed down the toilet bowl.

6 Claims, 4 Drawing Sheets

TOILET WATER RESERVOIR WATER DUMPING VALVE FOR SEALING THE RESERVOIR'S WATER OUTLET BY HYDRAULIC PRESSURE, AND CONTROLLING WATER VOLUME

BACKGROUND OF THE INVENTION

1. Field of the Invention

This invention relates to valves that control the flow of water from the outlet of the toilet water reservoir. More particularly, the invention relates to valves that prevent water leaks from such reservoir outlet. In addition, this invention relates to valves which control the amount of water which is permitted to exit from the toilet reservoir. More particularly, the invention relates to adjustable valves which can be customized to permit only a preset amount of water to exit from the outlet of the reservoir. Moreover, this invention relates to valves which prevent the undesirable continuous flow of water to the toilet bowl which results from valve malfunction. More particularly, this invention returns the flushing lever to its OFF position, such that it cannot get stuck in a flush position causing continuous water flow to the toilet bowl.

2. Description of the Related Art

Toilet flushing systems which comprise a conventional outlet control valve suffer from water drips. Variations in the design of the outlet valve are unable to prevent such drips. One way to design a long lasting valve, which will not easily erode, is to design it rigid and heavy. Yet, such design is defective because in case dirt accumulates at the outlet the valve will not be able to seal the outlet due to its rigidity. Thus, water will drip from between the outlet and the valve. A second design for such outlet valve is to make it soft and flexible, in order for the valve to seal the outlet even when dirt accumulates at the outlet. Yet, such design is defective for two reasons. First, soft valves easily erode in water, such that their shape changes, preventing their ability to seal the outlet. Second, soft valves are light in weight which hinders their ability to tightly seal the outlet. Any variation in water pressure in the reservoir causes their position to be easily disturbed.

Both the soft and hard valves are supposed to seal the outlet by gravity force acting on the outlet. Such gravity force is proportional to the weight of the water column acting on the valve's surface plus the valve's weight. Relying on the weight of the water to tightly keep the valve in place is not sufficient. In addition, since the valve's heavy weight results in its inflexibility, there is a tension between the need to design the valve heavy enough to tightly seal, yet, light enough to be flexible to fit the outlet even when there is dirt. Thus, since relying on the gravity force of the water column above the valve plus the weight of the valve is problematic, a more reliable method is needed in order for the valve to tightly seal the outlet.

Accordingly, it is the object of the present invention to provide a toilet valve which can tightly seal the reservoir's outlet even under conditions of dirt and erosion of the valve. More specifically, it is the object of this invention to provide a toilet reservoir outlet valve which is tightly seated against the outlet by hydraulic force, where such hydraulic force is greater than the gravity force conventionally relied upon.

It is an additional object of the present invention to provide an outlet valve which can be adjusted to control the quantity of water which can be flushed.

It is yet an additional object of the present invention to provide a mechanism which returns the flushing lever to its OFF position, such that it cannot get stuck in a flush position, resulting in the undesirable continuous flow of water to the toilet bowl.

SUMMARY OF THE INVENTION

To accomplish the foregoing and other objects, features and advantages of the present invention, a diaphragm housing is provided. Basically, the outlet valve is connected to a rod on which there is water pressure from a pressurized water supply. Such hydraulic pressure acting on the valve is greater than the gravity force resulting from the weight of the water and the weight of the outlet valve. This hydraulic pressure keeps the valve tightly seated on the reservoir outlet. When water is flushed, water pressure above the rod is released, and the rod, dragging the valve, moves away from the reservoir outlet, allowing water to be flushed to the toilet ball. During a flush mode, a diaphragm travels towards the flushing lever, to return it to its OFF position, preventing the undesirable flow of water to the toilet bowl. If addition, an adjustable water control feature limits the volume of water that can accumulate in the reservoir.

BRIEF DESCRIPTION OF THE DRAWINGS

The operation and advantages of the present invention will be more fully understood from the detailed description below, which should be read in conjunction with the accompanying drawings, in which.

DETAILED DESCRIPTION OF THE DRAWINGS

Figure 1:
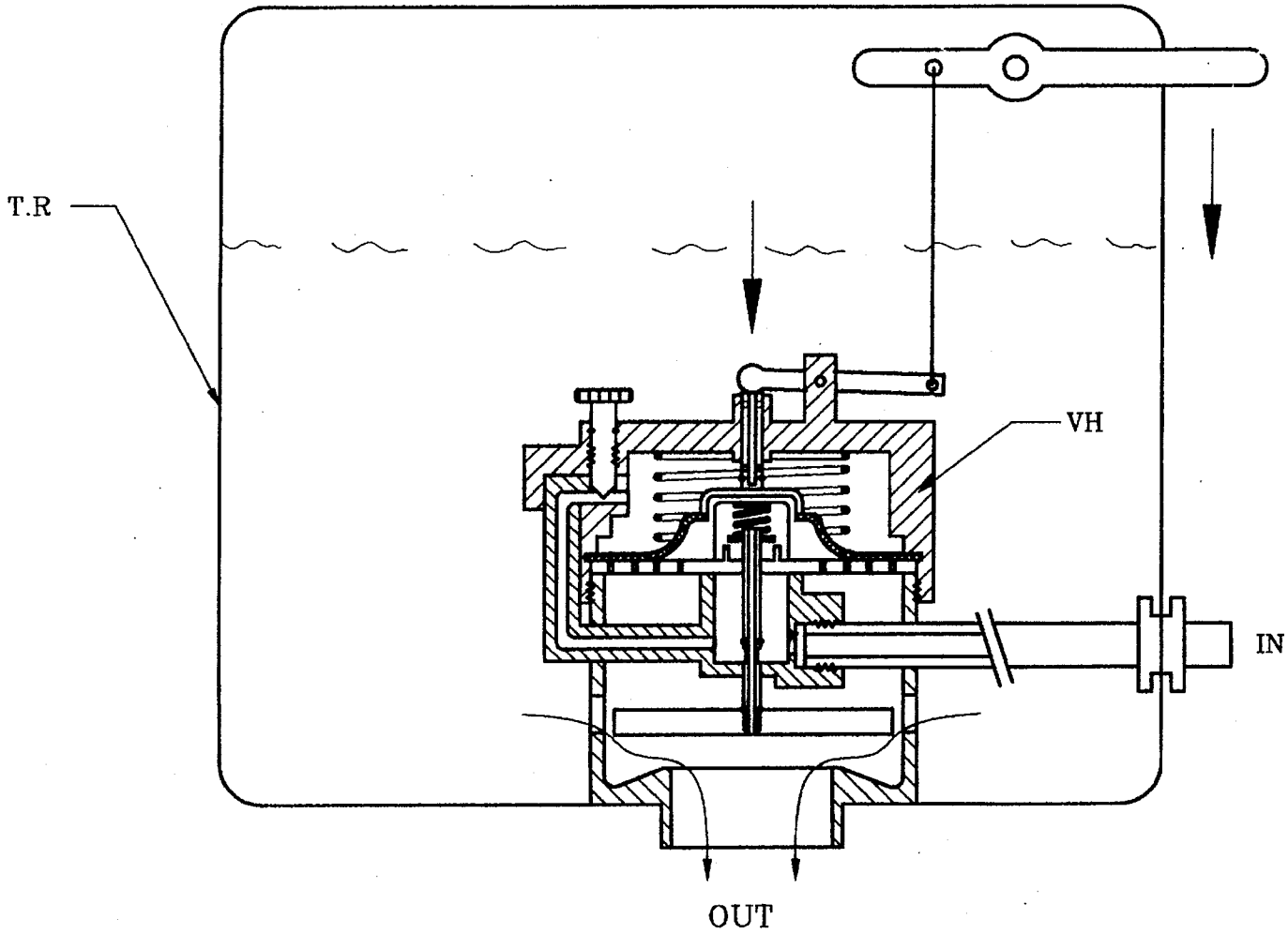
FIG. 1 is a drawing of the valve housing in the toilet reservoir in a flush position.

FIG. 1 illustrates the valve housing VH in the toilet reservoir TR, in a flush position.

Figure 2:
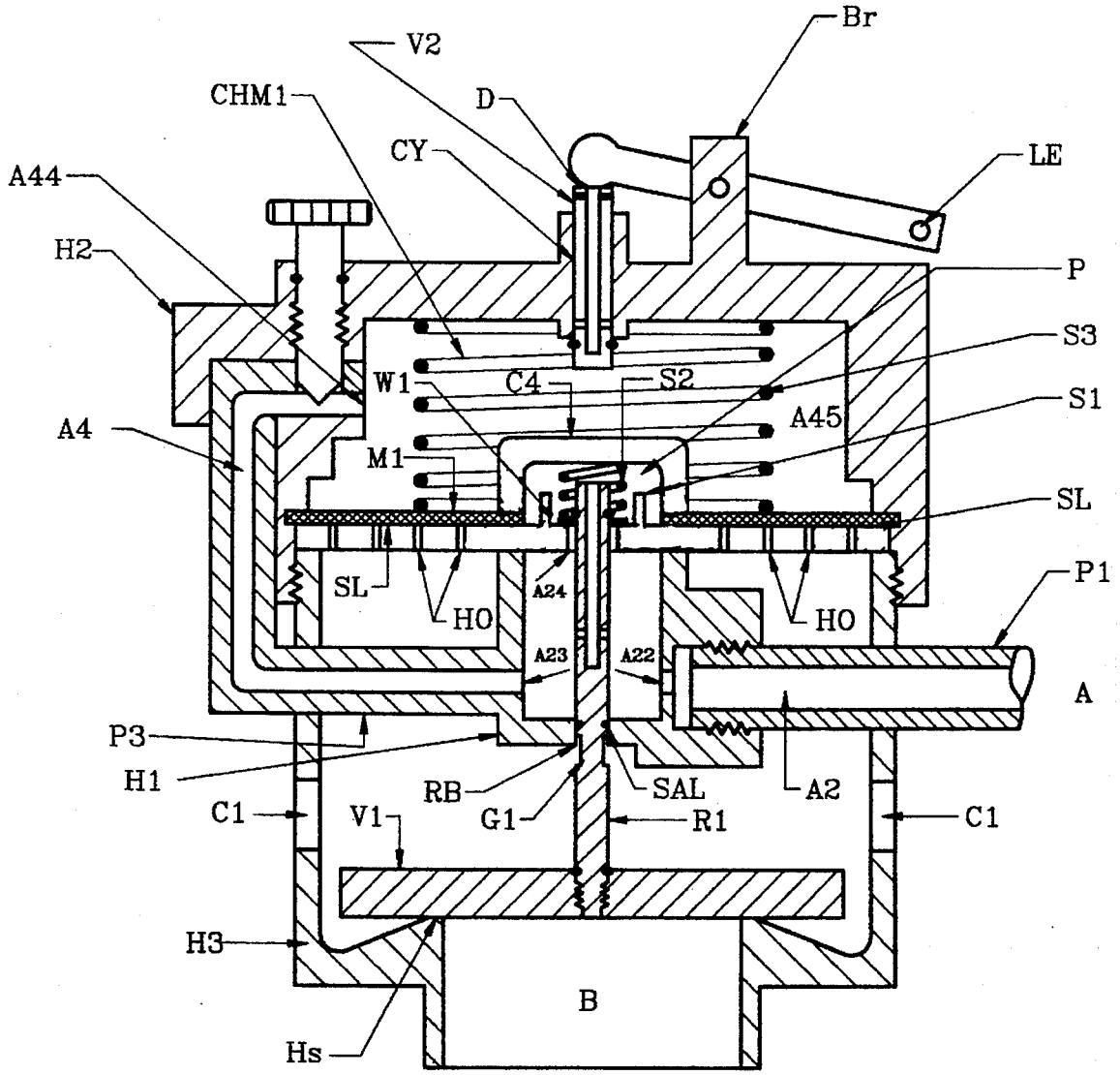
FIG. 2 is a cross sectional view of the valve housing.

FIG. 2 illustrates the valve housing. The valve housing is composed of three housings, H1, H2 and H3. The first housing H1 is a water conduit. The first housing has an inlet A22, a first outlet A23 and a second outlet A24. The second housing H2 has an inlet A44 an outlet to the reservoir A45 and a lower perforated surface SL, where the perforations HO form numerous outlets into the third housing H3. The third housing H3 has a main outlet B leading to the toilet bowl [not shown]. Lower surface SL forms the upper surface of housing H3. Perforations HO form numerous inlets from housing H2 into housing H3. Also housing H3 has inlets C1 for water from the reservoir [not shown].

Pressure line A is connected to the first end of pipe P1. The second end of pipe P1 is outlet A2 which is connected to the inlet A22 of housing H1. Outlet A23 of housing H1 is connected to the first end of pipe P3. The second end A4 of pipe P3 is the outlet of pipe P3 which is connected to inlet A44 of housing H2. A screw S controls outlet A4. The outlet B of housing H3 consists of a seat HS on which a flush valve V1 seats. Flush valve V1 is connected to the first end of rod R1. The second end of rod R1 slidingly fits into a radial bore RB in housing H1 and protrudes through housing H1. A washer W1 is mounted on the second end of rod R1. A sleeve S1 is connected outside housing H1 such that washer W1 can slide into sleeve S1 when rod R1 slides. Washer W1 covers outlet A24 of housing H1. The body of rod R1 can have an O ring SAL inside housing H1, to seal the housing H1 from the reservoir. Between the body portion of rod R1 and the flush valve V1 rod R1 can have a narrow portion G 1 for permitting water communication between housing H1 and the reservoir in a flush position.

A membrane M1 having a hole in the center is seated on the lower surface SL of housing H2. The membrane M1 covers the perforations HO of lower surface SL of housing H2. A cap C4 is attached to the hole of the membrane, forming a pocket P above the radial bore RB of housing H1. A spring S3 is mounted between membrane M1 and housing H2, urging the membrane against the surface SL as to cover holes HO. A spring S2 is mounted in the pocket P between washer W1 and cap C4. Spring S2 urges washer W1 against outlet A24 of housing H1, slightly sealing it; spring S2 in turn causes rod R1 to push valve V1 against seat HS. Housing H1 is in communication with the pocket P through an axial bore AX in rod R1 and/or through a space under the washer W1.

Housing H2 has a bore CY in which a valve vent V2 slides. Vent valve V2 has a bore D, such that when vent valve V2 is pressed, water from chamber CHM1 pass out to the reservoir. Exterior to housing H2 is a bracket BR where a lever LE is pivotally connected. Lever LE can move up and down to push vent valve V2 in and out of housing H2.

Figure 3:
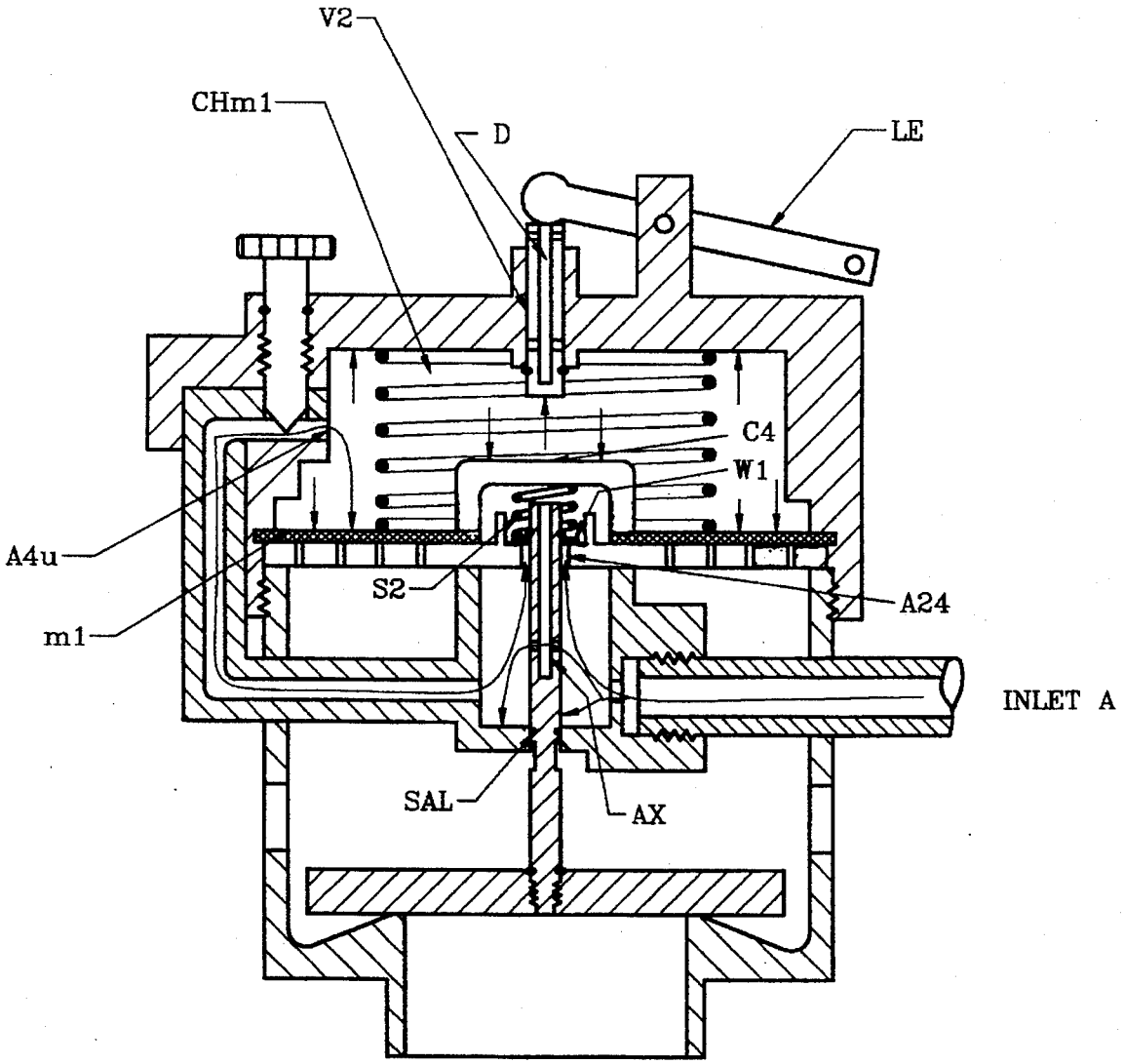
FIG. 3 is a cross sectional view of the valve housing before the water is flushed.

FIG. 3 shows the water flow situation in the valve when water is not flushed. If lever LE is in a released position, valve V2 closes bore D. When bore D is closed, pressured water from inlet A enters chamber CHM1 through inlet A44. As the water accumulates in chamber CHM1, pressure builds on diaphragm M1 and cap C4 which in turn forces spring S2 to urge washer W1 to seat against outlet A24. Simultaneously, pressured water from housing, H1 exits housing H1 through outlet A24, from under washer W1, or through the axial bore AX in rod R1, and enters the pocket P, building pressure on rod R1, which in turn pushes valve V1 to seat against seat HS and to seal outlet B. When valve V1 closes outlet B, it closes the passage of water from the reservoir to the toilet ball.

Figure 4:
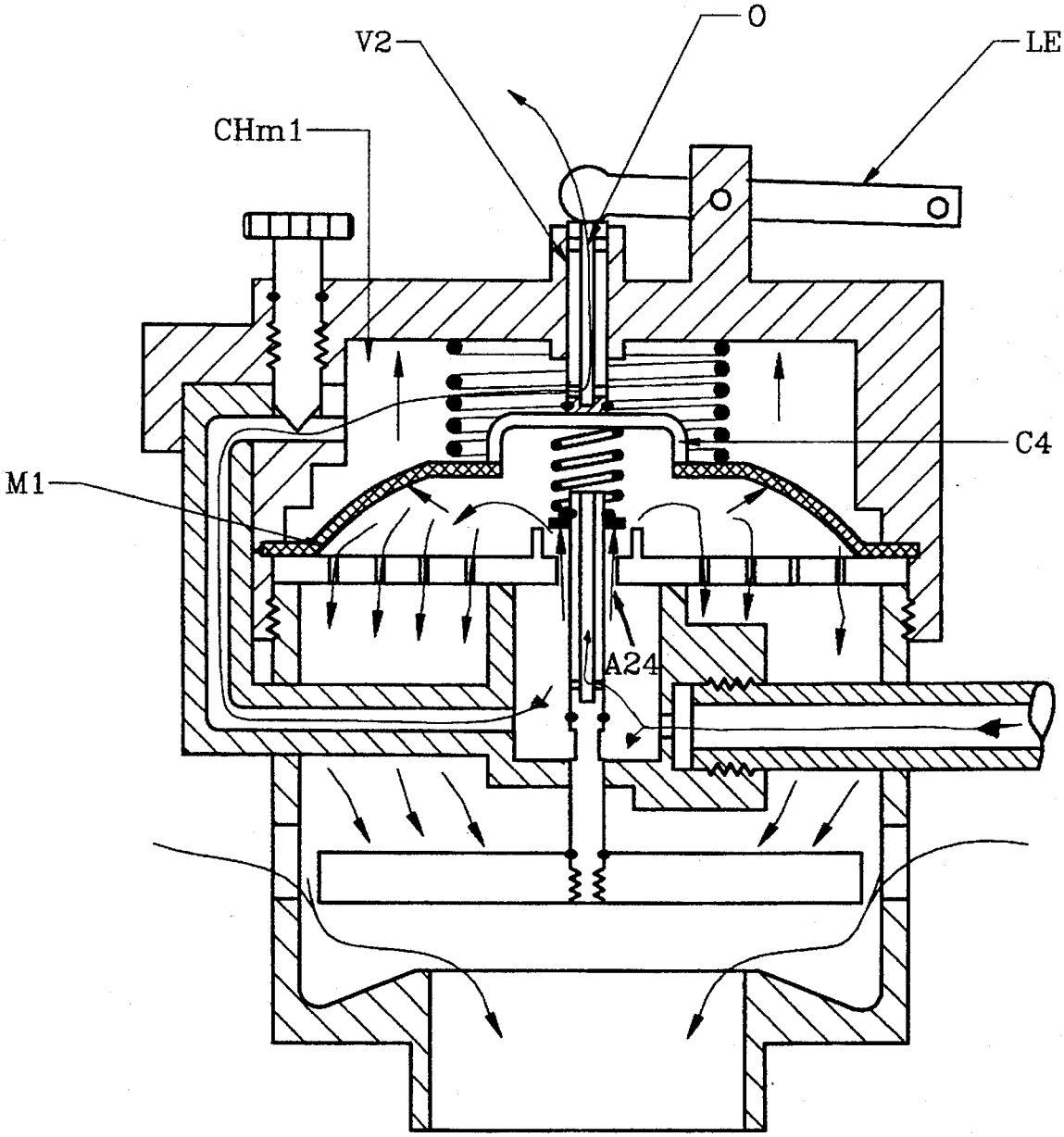
FIG. 4 is a cross sectional view of the valve housing as water is being flushed.

FIG. 4 shows the water flow in the valve when water is flushed. If lever LE is in a depressed position, it pushes valve V2 down to open opening bore D. When bore D opens, the pressure in chamber CHM1 decreases to zero, as all the water from CHM1 rushes out to the reservoir. Since water pressure exists under cap C4, a pressure differential is created above and below cap C4, causing cap C4 and membrane M1 to lift up toward vent valve V2. As cap C4 lifts up, it reduces the pressure on spring S2 which decreases the pressure on washer W1. At this point, water pressure from outlet A24 acting below washer W1 is greater than the force of the water and spring S2 on the top surface of washer W1. This causes washer W1 to be pushed up towards valve V2. Washer W1 drags rod R1 which drags valve V1 away from seat HS to open outlet B, allowing all the water from the reservoir to flush out the toilet bowl. When membrane M1 rises up, it opens outlets HO. In addition, when washer W1 moves away from outlet A24, water from inlet A rushes into pocket P and under membrane M1 and empties out of outlets HO into the reservoir. Rod R1 has an O ring SAL located at the bottom of housing H1. O ring SAL is situated above a narrow portion G1 of rod R1. O ring SAL seals the bottom portion of the radial bore RB in which rod R1 slides in the bottom of housing H1. O ring SAL insulates housing H1 from housing H3. As rod R1 moves up O ring SAL moves up exposing narrow portion G1 to chamber H1 such that water from inlet A can rush through housing H1 into housing H3, to clean up housing H1 from all the dirt.

When membrane M1 lifts up against spring S3, the washer W1 will come out of sleeve S1. This makes sure that valve V1 lifts all the way up before water will rush through the holes HO to fill the toilet tank.

As water empties out of chamber CHM1, cap C4 moves up more and more until it reaches valve V2. Cap C4 will then push valve V2 up, until an O ring OO on valve V2 insulates bore D from housing H2. As a result water pressure will build up in chamber CHM1 against membrane M1 and cap C4, pushing the membrane against outlets HO. This pressure acting on the upper surface of the membrane will overcome the water pressure acting below membrane M1, [either because of surface area differential and/or because of the force of the spring S3] returning the membrane M1 and cap C4 to cover holes HO. Simultaneously, cap C4 will apply pressure on spring S2 against washer W1 to close outlet A24. In turn, rod R1 will move down and move valve V1 to seat against seat HS, closing outlet B. Also, O ring SAL will return to its original position, sealing housing H1 from the reservoir. Again hydraulic pressure builds up on rod R1 causing valve V1 to tightly seat against seat HS, blocking outlet B of the reservoir. Simultaneously, pressure will continue to build up above membrane M1, until membrane M1 will seal all outlets HO. Until chamber CHM1 is full, water will continue to fill the reservoir. This creates a hydraulic timer.

By tightening screw S, one can lengthen the period in which water in housing H2 accumulates. The longer it takes housing H2 to fill up, the longer it takes for membrane M1 to be pressed against holes HO. This in turn translates to a longer period in which water from inlet A empties out of the reservoir into the toilet bowl, lengthening the flushing time, and increasing the volume of water that flushes out to the toilet bowl. If the screw is loosened, water in housing H2 accumulates quickly pushing membrane M1 against the holes HO, ending the communication between inlet A and the reservoir. This way the reservoir fills up more quickly and a lesser water volume is flushed.

This is just one possible embodiment to the invention. Variations in the design may include but are not limited to the following. Spring S3 can have adjustable means with which to increase or decease the force on it in order to maintain the same volume of water in housing H2, even in situations where the water pressure in the supply line is variable. Thus the spring becomes a pressure regulator when one adds the adjustable means to the spring. Another variation in the design is getting rid of spring S3. Membrane M1 can be pushed down against outlets HO either by spring S3 or without this spring if the upper surface of membrane M1 is greater than the lower surface, such that the water exposed to the upper surface is greater that the water exposed to the lower surface. Therefore, spring S3 can be eliminated if the upper and lower surface areas of the membrane are designed to result in the membrane moving down against holes HO once valve V2 returns to its OFF position. Another variation in the design includes mounting rod R1 on valve V1 by flexible means, rather than rigid means. Another variation is having membrane M1 cover lower surface SL, where the membrane does not have a hole to which a cap is connected. In such a configuration, the portion of the membrane forms the pocket above the radial bore.

I claim:

1. A toilet reservoir water flushing valve for sealing an outlet of said toilet reservoir and for controlling the amount of water released from said reservoir during a flush, said flushing valve comprising:

a first hollow housing adapted for mounting in said reservoir, said housing having:

a bottom portion, a top portion, an open bottom end, and a hollow interior, said interior adapted to be sealed against undesired intrusion of water from said reservoir;

a vent valve mounted in said top portion of said housing, said vent valve having a vent bore therein for communicating said hollow interior with said reservoir, said vent valve adapted to be controlled by a flushing lever associated with said toilet reservoir;

a water conduit having a first end adapted for connection to a pressurized water supply line, a water conduit branch having a first end connected thereto and a second end extending therefrom, and a radial bore therethrough;

a perforated wall connected to said bottom portion of said housing in said interior and covering said open bottom end, a second end of said water conduit being connected to a bottom surface of said perforated wall and opening therethrough into said first housing;

a water-impervious membrane connected to said housing in said interior above said perforated wall and below said vent valve such that said membrane seals and unseals said perforated wall against flow of water therethrough, said membrane forming a pocket above said perforated wall at said connection of said water conduit thereto;

said second end of said water conduit branch being connected to said top portion of said housing above said membrane so as to communicate water from said water conduit to said top portion of said housing;

a second hollow housing having:

an open upper end connected to said open bottom end of said first housing adjacent said perforated wall, an open lower end adapted for connection around an outlet opening in said toilet reservoir, and a surrounding side wall having openings therein for communicating an interior of said second housing with water in said toilet reservoir;

a valve seat adjacent said open lower end;

a valve for selectively covering and uncovering said valve seat so as to selectively permit flow of flushing water from said reservoir therethrough, into said outlet of said reservoir, and into an associated toilet bowl;

a rod having a first end, a body, and a second end, said first end being connected to said valve, said body being sealingly received in said bore of said conduit, said second end protruding through said bore, above said perforated wall, and into said pocket formed by said membrane, said rod having an axial bore therein extending from said second end into said conduit for allowing water to flow from said conduit into said pocket;

a disk connected to said second end of said rod for sealing said conduit against flow of water thereinto from said pocket; whereby, in a non-flush position, said vent valve seals said first housing from said toilet reservoir and pressurized water from said supply line is communicated through said water conduit, said water conduit branch, and into said interior of said first housing above said membrane, said pressurized water pressurizing said interior of said first housing, forcing said membrane downwardly to seal said perforated wall, pressurized water also entering said pocket through said axial bore in said rod, said water in said pocket urging said disk against said conduit and biasing said second end of said rod downwardly, pushing said valve onto said valve seat so as to preclude flow of water from said toilet reservoir into said second housing and through said outlet; and whereby, operation of said flushing lever moves said vent valve such that said vent bore establishes communication between the interior of said first housing, which is pressurized by said pressurized water supply, and said toilet reservoir, which is at a lower pressure, causing pressurized water from said first housing to be evacuated into said reservoir and allowing said membrane to move upwardly and unseal said perforated wall, said evacuation also allowing said second end of said rod to move upwardly and unseat said valve to allow water from said toilet reservoir to flow therethrough, into the outlet, and into said bowl to flush the contents thereof.

2. A flushing valve as in claim 1, wherein the first hollow housing includes a first urging means for urging said membrane against said perforated wall.

3. A flushing valve as in claim 2, wherein said first hollow housing includes a second urging means in said pocket for urging said disk against said water conduit.

4. A flushing valve as in claim 1, wherein said body of said rod has a narrow portion such that, when said rod moves upwardly during a flushing operation, water flowing from said pocket can flow through said bore in said conduit, around said narrow portion, and into said reservoir so as to clean said conduit of dirt.

5. A flushing valve as in claim 1, wherein movement of said membrane upwardly during a flushing operation moves said vent valve to a position which closes communication of said vent bore with said interior of said first housing and said toilet reservoir and urges said flushing lever to a rest position.

6. A flushing valve as in claim 1, wherein said water conduit branch has an adjustable water passage control means therein for restricting water flow from said conduit into said first housing so as to delay seating of said valve and allow more water to be flushed from said reservoir.

* * * * *